US006152831A

United States Patent [19]

Arcenas

[11] Patent Number: 6,152,831

[45] Date of Patent: Nov. 28, 2000

[54] HANDLOCKING METHOD OF INCREASING A GOLF CLUB'S ROTATIONAL FORCE

[76] Inventor: Rafael T. Arcenas, 1330 Crestwood Ave., Las Vegas, Nev. 89104

[21] Appl. No.: 09/170,824

[22] Filed: Oct. 13, 1998

[51] Int. Cl.[7] ..... A63B 53/14

[52] U.S. Cl. ..... 473/206; 473/409; 473/551

[58] Field of Search ..... 473/300, 301, 473/302, 303, 282, 298, 299, 286, 201, 203, 204, 205, 206, 409, 551

[56] References Cited

U.S. PATENT DOCUMENTS

| | | | |
|---|---|---|---|
| 1,075,054 | 10/1913 | Morley | 473/206 |
| 2,772,090 | 11/1956 | Brandon | 473/301 |
| 2,780,464 | 2/1957 | Ashley | 473/206 |
| 3,203,697 | 8/1965 | Berzatzy | 473/538 |
| 3,227,455 | 1/1966 | Hulsman | 473/206 |
| 3,845,955 | 11/1974 | Solheim | 473/226 |
| 3,992,021 | 11/1976 | Tobin | 280/821 |
| 5,135,226 | 8/1992 | Place | 273/166 |
| 5,163,685 | 11/1992 | Rhodes | 473/206 |
| 5,480,146 | 1/1996 | Thomasville | 273/814 |
| 5,704,845 | 1/1998 | Boyte | 473/205 |

*Primary Examiner*—Jeanette Chapman
*Assistant Examiner*—Stephen L Blau

[57] ABSTRACT

A handlocking method of increasing a golf club's rotational force and acceleration on a downswing utilizing a grip handlocking and levering device. The device is a tapered sleeve having a tongue shaped lever attached around an outer circumference surface of a proximal end of the sleeve. The device is attached to a grip end of a club. The golfer's lead hand is placed on the grip end of the club with the lever positioned behind and supporting the meaty side of the palm. The player holds the grip end of the club with the muscles of the hands relaxed while swinging the club such that a levering effect is created on the shaft of the club causing an increase in the rotational force and acceleration of the golf club.

1 Claim, 3 Drawing Sheets

HANDLOCKING METHOD OF INCREASING A GOLF CLUB'S ROTATIONAL FORCE

BACKGROUND—FIELD OF INVENTION

This invention relates to the game of golf, specifically to the importance of maintaining proper downswing grip and what my invention provides, to enable players to repetitively execute with ease, the elusive ideal grip without sacrificing control and safety.

BACKGROUND—DESCRIPTION OF PRIOR ART

Golf beginners and even professional players, admit that proper grip and synchronized graduated acceleration of the club, are probably the two most difficult routine that players must learn, if they intend to improve their game. The player's grip, which is the only link between the player and the club, must be properly executed with considerable degree of consistency. The distance and direction of the ball is then said to be greatly influenced by how the grip is applied.

The need to alleviate grip problem, created a big demand for solutions to minimize it's troublesome persistent recurrence. Approaches to the solution are varied as evidence by the presence of numerous expensive grip items in the market. Although the introduction of some high tech materials and elaborate design has somewhat minimize grip slippage, the expensive replacement frequency has gone up. Most of the prior arts in the field of golf grip patents also indicates this common expensive problem but failed to adequately come up with a reliable and longer lasting solution. Concentration of most prior art are directed merely on modifying materials and designs that promotes subjective individual needs such as arthritic impaired players and some device patents are intended for practice purposes only. The reader will note as indicated in my references, that another approach by most prior arts to enhance grip, is directed toward the improvement of the golf gloves which can duplicate the golfer's cost of grip replacement maintenance.

OBJECTS AND ADVANTAGES

Accordingly, the elusive solution to the grip problem endorsed by most prior arts, perpetually center on golf grip replacement by utilizing expensive high tech grip materials of various designs. However, because of the physical wear and tear, exposure to the elements of the environment and prohibitive replacement cost, most alternative remedy fall short of the player's expectation.

My present invention will not only provide the maximum solution to golfer's grip problem, it will also have a lasting duration of use, enough for the player to gain confidence and really enjoy his game. Among my objectives are:

1. To have the leading hand ideally handlocked in position from address to follow through without slippage.
2. To improve swing leverage without increasing length of the shaft.
3. To naturally encourage the clubhead to face the ball at point of impact.
4. To provide tool of assistance to players of weak handgrip cause by gender, age, joint arthritis of the hand.
5. To minimize costly repetitive grip replacement.
6. To improve safety and control of the golf club.
7. To enable players to consistently execute the ideal grip (firm but not tight).
8. To minimize the occurrence of divot in the fairways.

9. Most of all, to immediately improve the players game.

Further objects and advantages of my invention will become apparent from consideration of the ensuing drawings and description.

DRAWINGS AND FIGURES

In the drawings, closely related figures have the same number but different alphabetic suffixes.

REFERENCE NUMERALS IN DRAWINGS

Figure 1A:
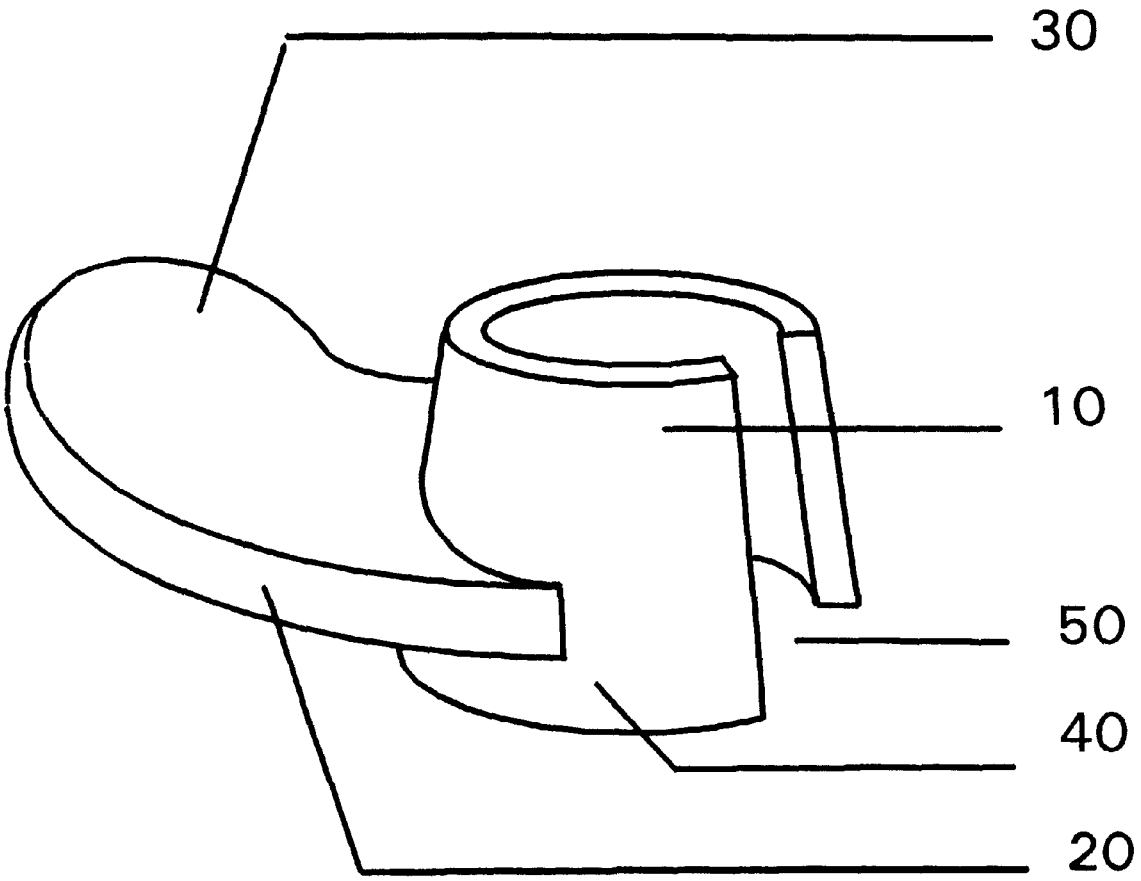
FIG. 1A Shows a perspective drawing of the invention with all the parts numerically identified.
Figure 1B:
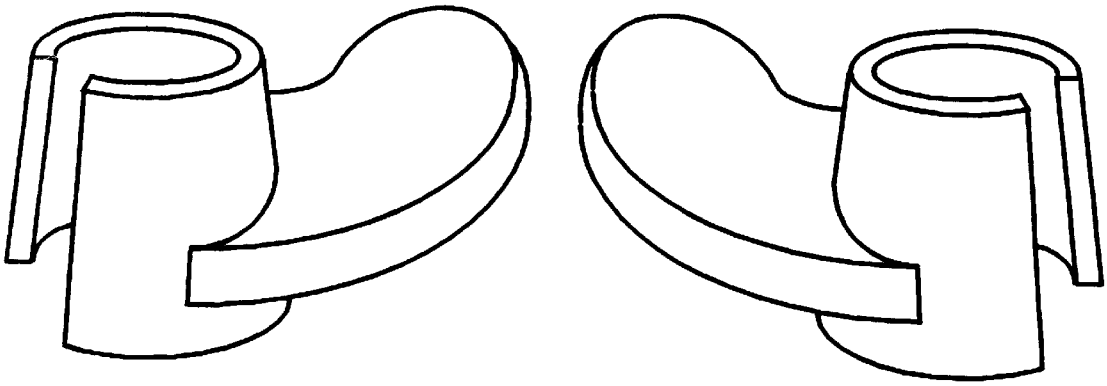
FIG. 1B Shows the invention how it can be universally use for left or right handed player.
Figure 1C:
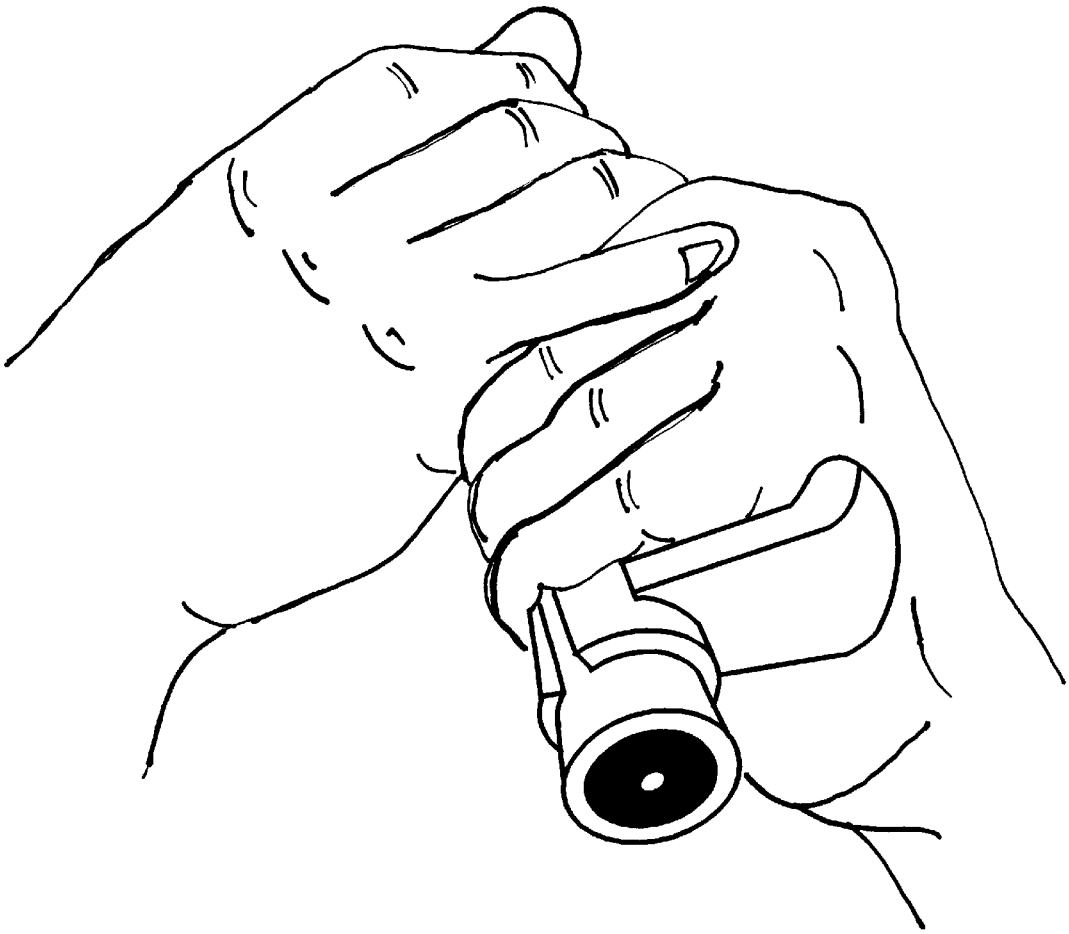
FIG. 1C Shows how the invention is use.

10 Tapered cylindrical sleeve
20 Sleeve lever
30 Sleeve lever cavity
40 Sleeve base end
50 Sleeve tapered shaft opening
60 Sleeve tapered cutout

SUMMARY

In accordance with my present invention, a golf club grip handlocking lever mounted around the desired grip end of the club, ideally located behind the golfer's lead hand, enabling the player to execute consistently a proper grip from address to the whole routine of the golf swing without grip slippage. The pressure of the hand against the handlocking lever creates a levering effect on the shaft, causing increase rotational force and acceleration without sacrificing both control and safety. The main objective of the invention is synergistic in approach. While the lever restrict physically the lead hand from slipping it also creates a rotational levering effect on the golf shaft.

DESCRIPTION—1A to 1C

My grip handlocking and levering device has two elementary parts. A tapered cylindrical sleeve 10 and a tongue-like lever 20 joined together as a unit. The said lever is transversely attached around the outer circumference surface of the sleeve's outer proximal base 40. The protruding free end of the lever, is slightly curve forming a cavity 30 to comfortably receive the palm's meaty side of the lead hand. A minimum tapered cutout 60 is made along the longitudinal side opposite the lever, to allow the smallest portion of the shaft close to the clubhead to enter the sleeve's opening 50. The device is push upward the shaft to the desired grip end. The lever is positioned relative to the setup of the club face, squarely facing the ball on the ground. Soap with water maybe used as lubricant to slidably facilitate mounting of the sleeve onto the desired grip end. The cutout portion of the sleeve maybe optionally glued back for additional strength.

EMBODIMENT AND RAMIFICATIONS

The development of the design of my handlocking lever was the result of applying the physic's lever principle and adapting it to the natural configuration of the hands as it hold the grip of the golf club. Placing the handlocking lever behind the meaty side of the palm's lead hand around the the grip, is the most effective synergistic application of the lever concept in golf. For ease of installation, the ideal embodiment of my invention would be the snap type, whereby the device is cut into two parts and snap assembled around the grip. However, this maybe sacrificing safety because of the unreliability of snap type of getting disassembled. Currently, my present design of the handlocking lever will have the advantage of reliability, adaptability and flexibility of usage on any type of club. Hard rubber, fiber glass, light metals, hard plastics, graphite composite and even wood can be used as production material. The synergistic grip handlocking and levering feature of my invention, makes it a practical application in variety of other sports. With slight modification, it can be used in other sports such as polo, tennis, martial arts, shooting competition where control of the handgrip is a must.

OPERATION

The manner of using my grip handlocking lever in golf, is almost inherently automatic. The most important operational step, is the normal positioning of the player's lead hand comfortably resting against the lever cavity, while executing his customary hold of the club grip. The handlocking lever, strategically located behind the lead hand will automatically prevent any hand slippage throughout the entire motion of the swing. Thus allowing the player initiate consistently the ideal golf grip (holding the grip firmly but not tight). The relax muscle of the hands will enable the whole body to maintain a graduated down swing acceleration.

I claim:

1. A method of increasing a golf club's rotational force and acceleration on a downswing comprising the steps of:

attaching a handlocking and levering device around a grip end of said club, said device having a tapered sleeve, said sleeve having a proximal base end, a protruding tongue shaped lever attached around an outer circumference surface of said base end of said sleeve, and a tapering cutout along a longitudinal side of said sleeve;

placing a golfer's lead hand on said grip end of said club such that said lever is positioned behind the meaty side of the palm of the lead hand supporting an area between the little finger and the wrist; and holding said grip end of said club with muscles of the hands relaxed while swinging said club such that a levering effect is created on said shaft of said club causing an increase in a rotational force and acceleration on said golf club.

* * * * *